US012365530B1

(12) United States Patent
Hill

(10) Patent No.: US 12,365,530 B1
(45) Date of Patent: Jul. 22, 2025

(54) DOG WASTE STORAGE CONTAINER AND BAG DISPENSER

(71) Applicant: Thomas Hill, East Providence, RI (US)

(72) Inventor: Thomas Hill, East Providence, RI (US)

( * ) Notice: Subject to any disclaimer, the term of this patent is extended or adjusted under 35 U.S.C. 154(b) by 426 days.

(21) Appl. No.: 17/748,279

(22) Filed: May 19, 2022

(51) Int. Cl.

| | |
|---|---|
| ***A45F 5/00*** | (2006.01) |
| ***B65D 43/02*** | (2006.01) |
| ***B65D 51/28*** | (2006.01) |
| ***B65D 83/08*** | (2006.01) |
| ***E01H 1/12*** | (2006.01) |

(52) U.S. Cl.
CPC ..... *B65D 83/0805* (2013.01); *A45F 5/00* (2013.01); *B65D 43/0231* (2013.01); *B65D 51/28* (2013.01); *B65D 83/0888* (2013.01); *E01H 1/1206* (2013.01); *A45F 2005/002* (2013.01); *B65D 2543/00092* (2013.01); *B65D 2543/00527* (2013.01); *B65D 2543/00537* (2013.01)

(58) Field of Classification Search
CPC ..... B65D 83/0805
See application file for complete search history.

(56) References Cited

U.S. PATENT DOCUMENTS

| | | | | |
|---|---|---|---|---|
| 5,011,536 | A * | 4/1991 | Boom | A45F 5/10 134/42 |
| 6,578,730 | B2 | 6/2003 | Trunsky | |
| 6,588,375 | B2 | 7/2003 | Benedettini | |
| 2010/0126998 | A1* | 5/2010 | Wilson | B65D 51/28 220/495.07 |
| 2010/0168685 | A1* | 7/2010 | Drown | A61K 31/19 604/289 |
| 2017/0233136 | A1* | 8/2017 | Cartledge | B65D 21/0228 222/130 |
| 2018/0319571 | A1* | 11/2018 | Villarreal | B65D 43/163 |
| 2019/0337716 | A1* | 11/2019 | Mollo | B65F 1/062 |

* cited by examiner

*Primary Examiner* — Gene O Crawford
*Assistant Examiner* — Ayodeji T Ojofeitimi
(74) *Attorney, Agent, or Firm* — Sanchelima & Associates, P.A.; Jesus Sanchelima; Christian Sanchelima

(57) ABSTRACT

A dog storage waste container and bag dispenser including a container assembly that comprises a cylindrical dispensing assembly with a lid assembly and an attaching assembly on the side of the container assembly. The container assembly has a cylindrical body with an aperture to screw the internal threaded portion of the dispensing assembly with the external threaded portion of the container. The lid assembly is located on top of the container assembly in such a way to seal the dispensing assembly and it has a lid opening to pull up the bags to come out. An attaching assembly that comprises a clamp shape is fastened on the side of the container assembly with a couple of fasteners in such a way that is attached to a clip to hold on the user.

13 Claims, 5 Drawing Sheets

DOG WASTE STORAGE CONTAINER AND BAG DISPENSER

BACKGROUND OF THE INVENTION

1. Field of the Invention

The present invention relates to a dog storage waste container and bag dispenser and, more particularly, to dog storage waste container and bag dispenser that includes a portable cylindrical container to hold filled waste bags with a threaded hollow cover to store dispensing bags.

2. Description of the Related Art

Several designs for a dog storage waste container and bag dispenser have been designed in the past. None of them, however, include a portable container wherein filled wasted bags can be inserted and disposed of correctly, in addition it is comprising a dispensing bag for the collection of animal waste.

Applicant believes that a related reference corresponds to U.S. Pat. No. 6,578,730 issued for disclosing a container for holding and dispensing a roll of plastic film bags and a used bag disposal receptacle. Applicant believes that another related reference corresponds to U.S. Pat. No. 6,588,375 issued for disclosing a cylindrical container which can be mounted to an animal leash wherein the container is used to store and dispose of filled waste collection bags. None of these references, however, teach of a portable cylindrical container which is carried by or attached to a pet owner or a leash wherein in the container has a threaded hollow cover which dispenses disposable bags for the collection of animal waste and the interior of the container is used to hold filled waste bags until they can be disposed of properly.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a waste storage container and bag dispenser that allows the user to store soiled bags therein to prevent odors from the animal waste when depositing the bag in the container due to a screw lid seal which allows the animal waste to properly dispose of waste animal.

It is another object of this invention to provide a waste storage container and bag dispenser that allows the user to easily pull-out disposable bags from a dispenser.

It is still another object of the present invention to provide a waste storage container and bag dispenser that includes an attaching member which permits the user to attach the container to a backpack, to a belt loop, or the like to easily carry the invention.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
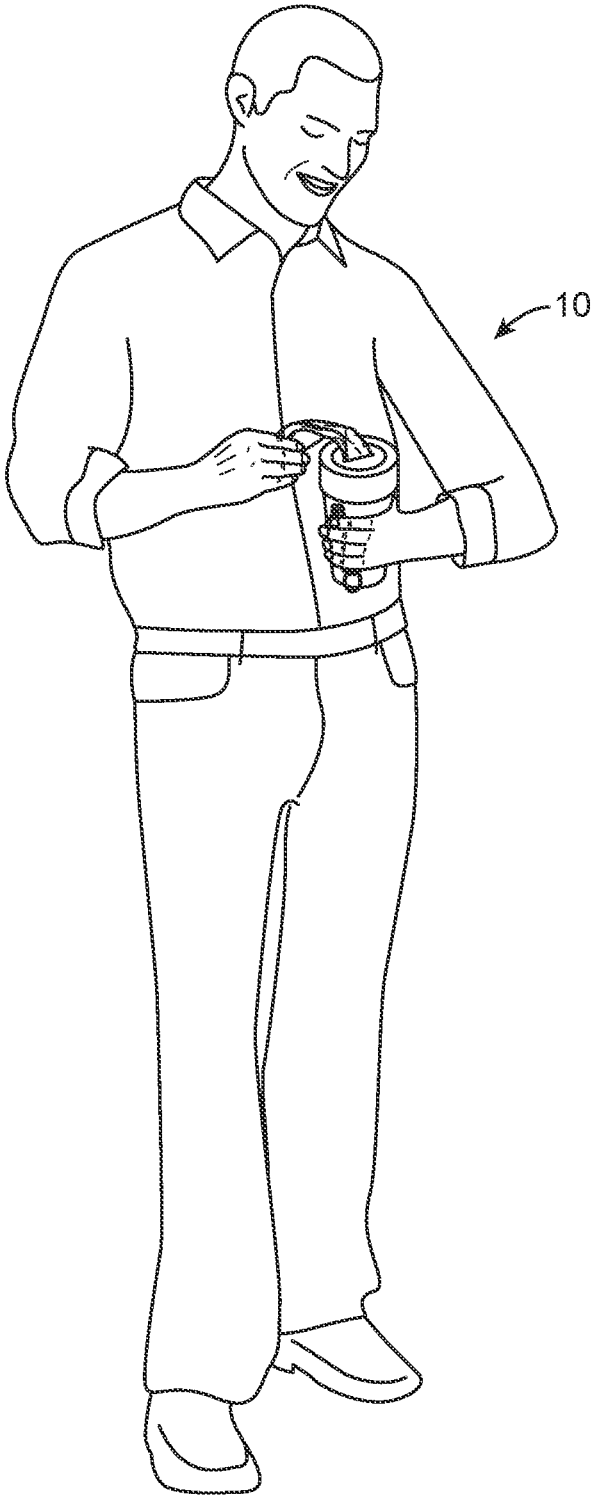
FIG. 1 represents an operational view of the present invention 10 wherein a user is pulling out disposable bags 46 thereof.
Figure 2:
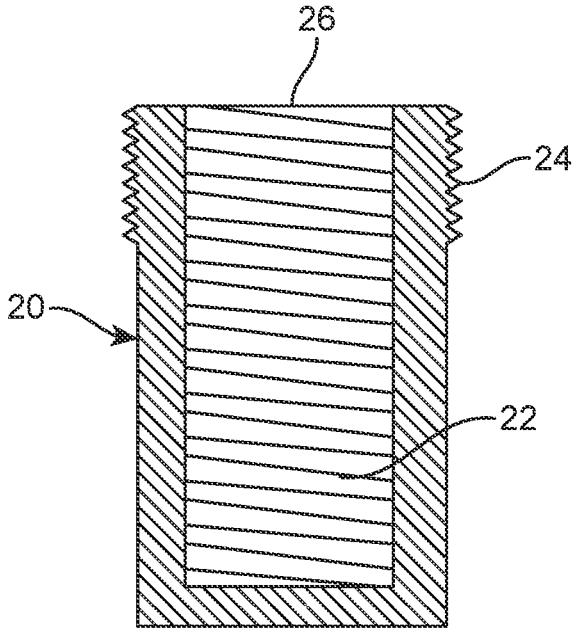
FIG. 2 illustrates a sectional view of the container 22 from the container assembly 20. Said container having an external threaded portion 24 and a container opening 26.

Referring now to the drawings, where the present invention is generally referred to with numeral 10, it can be observed that it basically includes a container assembly 20, a dispenser assembly 40, a lid assembly 60 and an attaching assembly 80. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The container assembly 20 includes a container 22, said container includes an external threaded portion 24 and a container opening 26. It may be suitable for a container 22 to be made of plastic or metal, or any kind of material that is capable of presenting resistance when storing something on it. Nevertheless, in other embodiments container 22 may be made of polymers, ceramics, rubber or any variation thereof. It is to be understood that the dispenser assembly 40 may be inserted in container 22, a lid assembly 60 may be placed on a top surface of the container 22 and the attaching assembly 80 may be attached on container 22. In a suitable embodiment container 22 may be volumetrically suitable to store a pet waste therein. However, in different embodiments the container 22 may have a cuboid shape, a rectangular shape, a tube shape, a cup shape, a triangular shape, or any variation thereof. It may be suitable for container 22 to have an external threaded portion 24 located at a top portion of the container 22. However, in another embodiment, the container 22 may have a slidable portion, a gripping portion, a smooth portion, a corrugated portion, or any variation thereof, located in an internal portion of the container 22. External threaded portion 24 may be further defined by a top portion of the container 22. It may be suitable to mention that container 22 may have a container opening 26 placed at a top portion of the container 22. Nevertheless, in another embodiments container 22 may have a container opening 26 placed at a bottom portion, a side portion, edge portion, front portion, rear portion, or any variation thereof. Container opening 26 may be volumetrically suitable to fit the lid assembly 60. In one embodiment, container opening 26 may be suitable to have a cylindrical shape. However, container opening 26 may have a cubic shape, hexagon shape, triangular shape, or any variation thereof. Container opening 26 may be suitable to be made of a silicone material to provide a better fit to any object. Nevertheless, container opening 26 may be made of a material like plastic, ceramic, metal, rubber, or any variation thereof.

Figure 3:
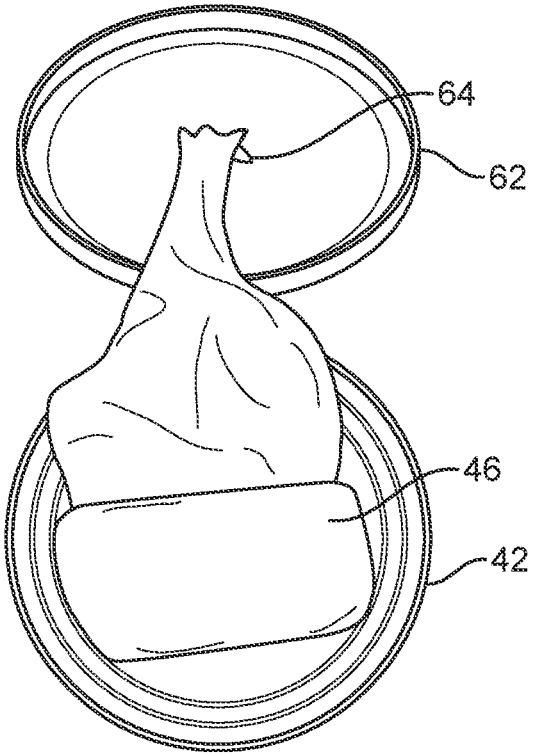
FIG. 3 shows a top view of the dispenser 42 having disposable bags 46 therein. Dispenser 42 contains disposable bags 46 therein, disposable bags 46 pass through the lid opening 64 from the lid 62.
Figure 5:
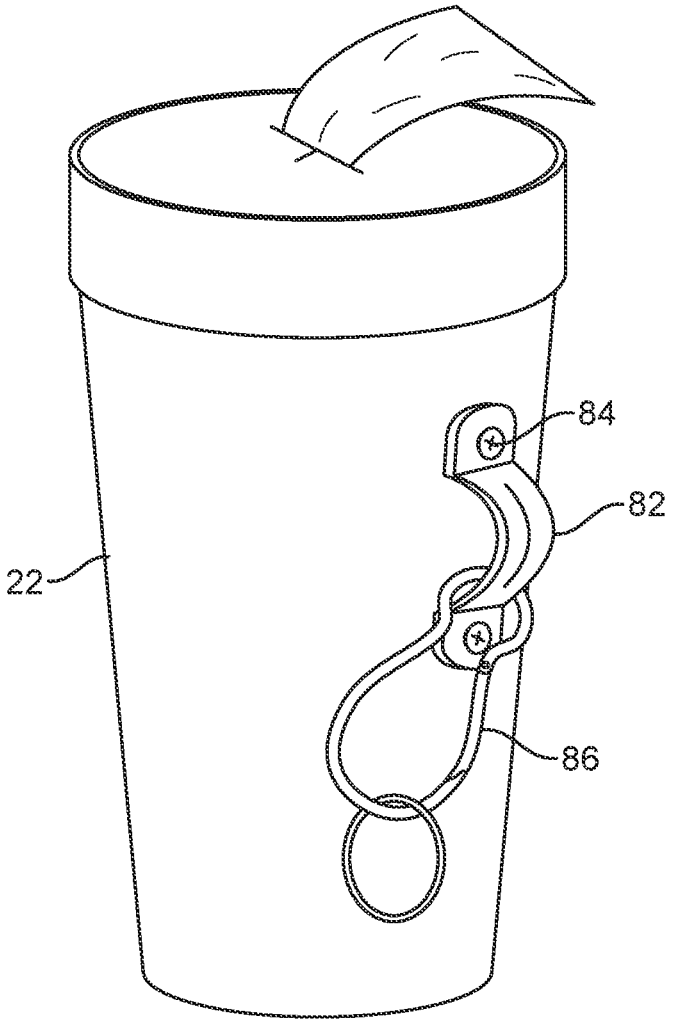
FIG. 5 is an enlarged view of the attaching assembly 80 attached to the container 22 with a couple fasteners 84, a clip 86 is holding from the attaching member 82.

The dispensing assembly 40 may include a dispenser 42, an internal threaded portion 44, disposable bags 46, and a dispenser opening 48. Dispenser 42 may have a shape that conforms with the shape of the container 22. However, dispenser 42 may have a cuboid shape, triangular shape, hexagon shape, oval shape, or the like as container 22 may have as well. In a suitable embodiment the dispenser 42 may be in a top portion of the container 22. However, in different embodiments dispenser 42 may be in a bottom portion, a medium portion, a top portion, a under portion or the like. As shown in FIG. 5, dispenser 42 may have an internal threaded portion 44 covering the outline of the dispenser 42 however, in other embodiments internal threaded portion 44 may partially cover a half outline portion or a third of the outline of the dispenser 42. Dispenser 42 may comprise a room big enough that can store pet waste. As shown in FIG. 5 dispenser 42 may include an internal threaded portion 44. It is to be understood that the internal threaded portion 44 may be used for screwing the external threaded portion 24. In one embodiment, internal threaded portion 44 may be made of a polypropylene material to have a better sail with the external threaded portion 24 of the container 22. However, in different embodiments, internal threaded portion 44 may be made of a rubber material, a metal material, an aluminum material, a plastic material, or any variation thereof. In a suitable embodiment, internal threaded portion 44 may be cover the inner outline of the dispenser 42. Nevertheless, internal threaded portion 44 may partially cover an inner bottom portion, an inner top portion, an inner medium portion, an inner half portion, or the like. Internal threaded portion 44 may have a unified thread form. In other embodiments, internal threaded portion 44 may have a metric threaded form, a square threaded form, a buttress threaded form, or any variation thereof. Dispenser 42 may include disposable bags 46 located at an internal portion 44. As best observed in FIG. 3 disposable bags 46 may be volumetrically smaller than the body of the dispenser 42. Disposable bags 46 may be made of heavy-duty degradable polyethylene that allow to the bag to withstand dog waste. However, in different embodiments disposable bags 46 may be made of low-density polyethylene, linear polyethylene, high density polyethylene, non-biodegradable plastic polymer or any variation thereof. In a suitable embodiment, disposable bags 46 may be also configured to control odor when tying a single bag. As shown in FIG. 5 dispenser 42 may include a dispenser opening 48. Dispenser opening 48 may be located at a top surface of the dispenser 42 concentric to the container opening 26. Nevertheless, dispenser opening 48 may be in an under surface, a bottom surface, a side surface, an edge surface, or the like. Dispenser opening 48 may be volumetrically suitable to deposit the disposable bags 46 through the dispenser opening 48. As illustrated in FIG. 3 dispenser opening 48 may have a circular shape as the dispenser 42. Nevertheless, dispenser opening 48 may have a square shape, triangular shape, hexagon shape, rectangular shape, or any variation thereof. Dispenser opening 48 may be made of a rubber material. In other embodiments, dispenser opening 48 may be made of a ceramic material, a metal material, a wood material, or the like.

Figure 4:
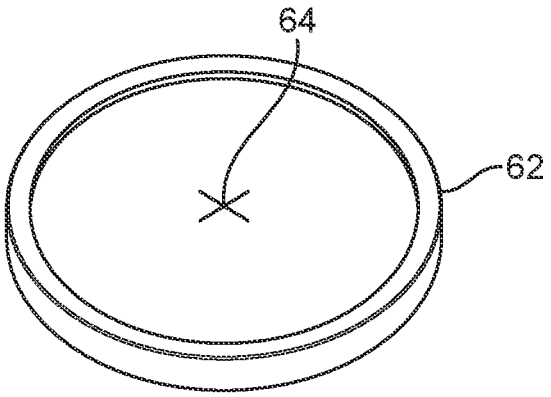
FIG. 4 represents a top side view of the lid assembly 60. Lid 62 has an inlet which is located on a center of the surface from the lid 64.

There is another embodiment to arrange the container 22 and the dispenser 42 like the lid assembly 60 which includes a lid 62. The lid 62 may include a lid opening 64. It is to be understood that lid 62 may be concentrically placed over the edges of the container 22 and more particularly to the container opening 26 also over the edge of the dispenser 42 and more particularly to the dispenser opening 48. As best observed in FIG. 5 lid 62 may have a circular shape to fit a sail the dispenser opening 48. Nevertheless, lid 62 may have a square shape, a triangular shape, a rectangular shape, a hexagon shape, a pentagonal shape, or any variation thereof. In a suitable embodiment lid 62 may be made of a resistant material like polypropylene. However, in different embodiments, lid 62 may be made of a metal material, wood material, rubber material, ceramic material, or the like. Lid 62 may be placed on a top surface of the dispenser 42 and may cover a top surface of the container opening 26. In other embodiments, lid 62 may cover a top surface of the container opening 26. Best observed in FIG. 4, lid 62 may have a lid opening 64 over a top surface of the lid 62. Lid opening 64 may be located at a center of the top surface of the lid 62. In different embodiments, lid opening 64 may be located on an ending of the lid 62. Lid opening 64 may be volumetrically suitable to allow the entrance of a disposable bag. Lid opening 64 may have a cross shape, a circular shape, a triangular shape, or any variation thereof. It is to be understood that lid opening 64 may have a similar material of the lid 62.

Figure 6:
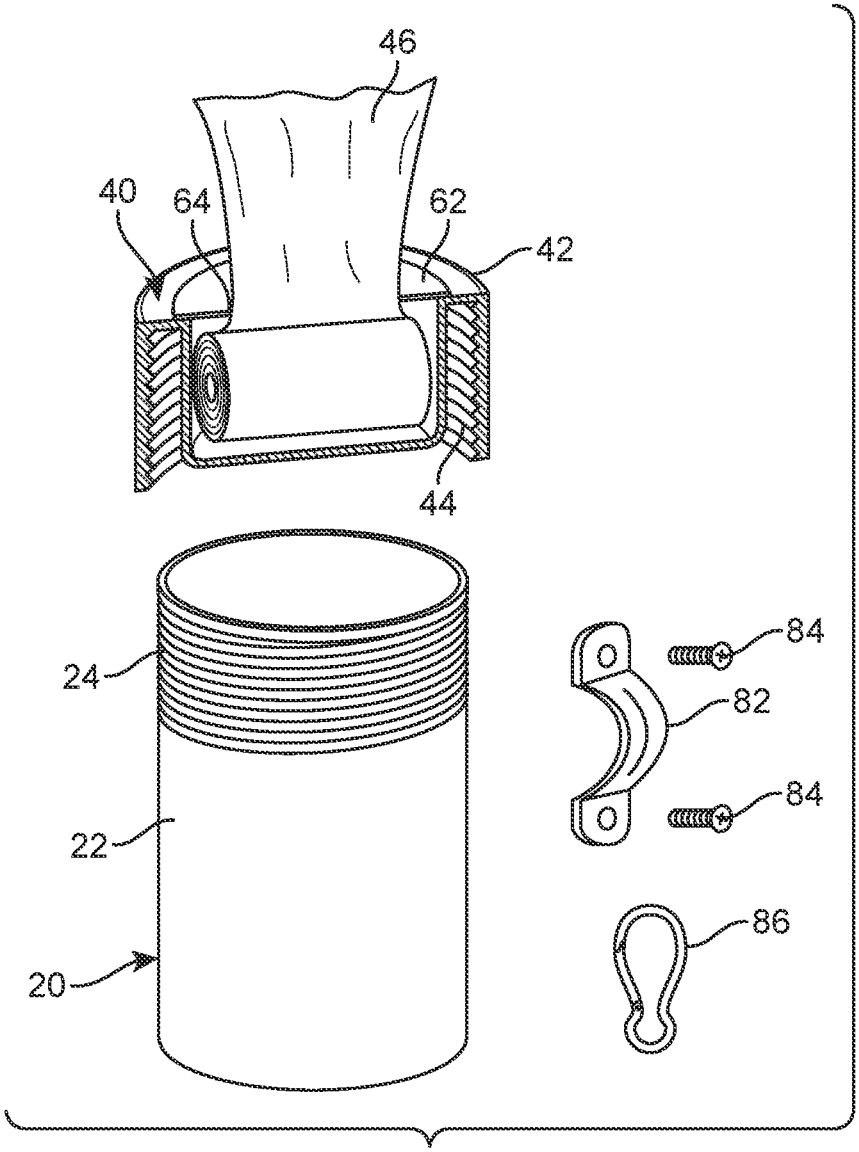
FIG. 6 is an exploded view of the container 22. Dispensing assembly 40 is located over the container 22, an internal threaded portion 44 screws the external threaded portion 24, a dispensing opening 48 is located on a top surface of the dispenser 42 where are stored disposable bags 46 therein. A lid 62 is located over the dispenser assembly 44, lid opening 64 is located at a center of the lid 62. An attaching member 82 is located on a side of the container 22, a couple of fasteners 84 are located on the end surfaces of attaching member 82, a clip 86 is located under the attaching member 82.

Attaching assembly 80 includes an attaching member 82, fasteners 84, and a clip 86. In a suitable embodiment the attaching member 82 may be attached to lateral side of the container 22. Nevertheless, in different embodiments, attaching member 82 may be attached to an underside, a top side, half side, downside, or the like. Attaching member 82 may be made of a rigid material as metal. In other embodiments, attaching member 82 may be made of a plastic material, a wood material, a polymer material, or any variation thereof. It should be noted as shown in FIG. 5 that attaching member 82 may have a clamp body. However, attaching member may have a pull handle body, an arc body, a clip body, or the like. Two distal ends of the attaching member 82 may include a portion set a couple of fasteners 84. However, distal ends of the attaching member 82 may present a flat surface. In a suitable embodiment, fasteners 84 may be a rivet. In different embodiments fasteners 84 may be a screw, an eye bolt, a nail, or any variation thereof. It should be noted that fasteners 84 may be attached to the attaching member 82 towards the container 22. One of the two members of fasteners 84 may be placed on a distal end of the attaching member 82. A second fastener of the two fasteners 84 may be placed on an opposite distal end of the first fastener member of the fasteners 84. Another embodiment is shown in FIG. 6 wherein fasteners 84 may be made of a rigid material. Attaching member 82 includes a clip 86. In a suitable embodiment clip 86 may have the shape of a snap hook. Nevertheless, in different embodiments, clip 86 may have the shape of a ring keyring, a lobster claw, plastic trigger clip, or the like. Clip 86 may be made of a rigid material. In a suitable embodiment clip 86 may be fastened to the attaching member 82.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A dog storage waste container and bag dispenser, comprising:

a container assembly including a container wherein said container has a cylindric and hollow body, said container includes an external threaded portion, wherein said container has a bottom portion to receive bagged pet waste;

a dispenser assembly including a dispenser, said dispenser is located at a top portion of the said container, said dispenser has a cylindrical body defining a longitudinal axis and including an internal compartment configured to store a plurality of disposable bags in a rolled configuration; the dispenser has an inner cylindrical wall defining the internal compartment, the inner cylindrical wall extending longitudinally to form a tubular cavity for housing the plurality of disposable bags; the dispenser has an outer annular wall concentrically surrounding the inner cylindrical wall, the outer annular wall defining an annular space between the inner cylindrical wall and the outer annular wall, wherein the outer annular wall includes an internal surface having an internal thread configured to threadedly engage the external threaded portion of the container; the dispenser includes a radially extending flange disposed at an upper end of the inner cylindrical wall that connects said inner cylindrical wall to said outer annular wall; the dispenser includes a dispenser opening disposed on the radially extending flange;

a lid assembly including a lid placed on a top surface of the said dispenser, said lid is a detachable lid; and an attaching assembly including an attaching member attached to a container said attaching member includes a plurality of fasteners, at least one of the fasteners of the plurality of fasteners is attached to a distal end of the said attaching member to interlock said attaching member with said container, wherein the attaching member is made of a rigid material, wherein the plurality of fasteners are screws that secure the attaching member to a lateral side of the container, wherein said attaching member includes a clip fastened to said attaching member.

2. The dog storage waste container and bag dispenser of claim 1, wherein said container includes a container opening that permit to insert said dispenser therein.

3. The dog storage waste container and bag dispenser of claim 1, wherein said dispenser includes an internal threaded portion, wherein said internal threaded portion interlocks said container with the dispenser.

4. The dog storage waste container and bag dispenser of claim 1, wherein said dispenser stores said disposable bags at a top portion of the container.

5. The dog storage waste container and bag dispenser of claim 3, wherein said disposable bags are pulled through said lid opening.

6. The dog storage waste container and a bag dispenser of claim 1, wherein said lid is a removably lid which lids the internal threaded portion of the dispenser.

7. The dog storage waste container and a bag dispenser of claim 1, wherein said lid includes a lid opening placed on a top surface thereof.

8. A dog storage waste container and bag dispenser, comprising:

a container assembly including a container wherein said container has a cylindric and hollow body, said container has a bottom portion configured to receive bagged pet waste, said container includes an external threaded portion at a top outline, said container includes a container opening that permit to insert said dispenser, said external threaded portion interlocks and seal the container with said dispenser;

a dispenser assembly including a dispenser, said dispenser is located at a top portion of the said container, said dispenser has a cylindrical body defining a longitudinal axis and including an internal compartment configured to store a plurality of disposable bags in a rolled configuration; the dispenser has an inner cylindrical wall defining the internal compartment, the inner cylindrical wall extending longitudinally to form a tubular cavity for housing the plurality of disposable bags; the dispenser has an outer annular wall concentrically surrounding the inner cylindrical wall, the outer annular wall defining an annular space between the inner cylindrical wall and the outer annular wall, wherein the outer annular wall includes an internal surface having an internal thread configured to threadedly engage the external threaded portion of the container; the dispenser includes a radially extending flange disposed at an upper end of the inner cylindrical wall that connects said inner cylindrical wall to said outer annular wall; the dispenser includes a dispenser opening disposed on the radially extending flange; the dispenser stores disposable bags which are pulled;

a lid assembly including a lid placed on a top surface of the said dispenser, said lid is a detachable lid, said lid includes a lid opening placed on a top surface of the said lid, said disposable bags are pulled through said lid opening; and an attaching assembly including an attaching member attached to said container said attaching member includes a plurality of fasteners, at least one fastener from the plurality of fasteners is attached to a distal end of said attaching member to interlock said attaching member to said container, said attaching member includes a clip fastened to said attaching member, wherein the attaching member is made of a rigid material, wherein the plurality of fasteners are screws that secure the attaching member to a lateral side of the container, wherein said clip is configured to attach said container to a user.

9. A dog storage waste container and bag dispenser of claim 8, wherein said internal threaded portion is located at a top portion of said container.

10. A dog storage waste container and bag dispenser of claim 8, wherein said internal threaded portion screws into said external threaded portion of said container.

11. A dog waste container and bag dispenser of claim 8, wherein said lid opening is located at the center of the top surface of the lid.

12. A dog waste container and bag dispenser of claim 8, wherein said lid opening defines an outlet for said disposable bags of said dispenser.

13. A dog storage waste container and bag dispenser, consisting of:

a container assembly including a container wherein said container has a cylindric and hollow body, said container includes an external threaded portion, said container includes a container opening, said external threaded portion is configured to interlock the container with said dispenser, said external threaded portion is located at the top portion of said container, wherein said container has a bottom portion to receive bagged pet waste;

wherein said dispenser is located at a top portion of the said container, said dispenser has a cylindrical body defining a longitudinal axis and including an internal compartment configured to store a plurality of disposable bags in a rolled configuration; the dispenser has an inner cylindrical wall defining the internal compartment, the inner cylindrical wall extending longitudinally to form a tubular cavity for housing the plurality of disposable bags; the dispenser has an outer annular wall concentrically surrounding the inner cylindrical wall, the outer annular wall defining an annular space between the inner cylindrical wall and the outer annular wall, wherein the outer annular wall includes an internal surface having an internal thread configured to threadedly engage the external threaded portion of the container; the dispenser includes a radially extending flange disposed at an upper end of the inner cylindrical wall that connects said inner cylindrical wall to said outer annular wall; the dispenser includes a dispenser opening disposed on the radially extending flange; the dispenser stores disposable bags which are pulled;

a lid assembly including a lid placed to a top surface of the said dispenser, said lid is a detachable lid, said lid includes a lid opening located on a top surface of the said lid, said lid opening is located at the center of a top surface of said lid, said lid is configured as an outlet for the configured as an outlet for said disposable bags of said dispenser; and an attaching assembly including an attaching member attached to a container said attaching member includes a plurality of fasteners, at least one of the fasteners of the plurality of fasteners is attached to a distal end of the said attaching member to interlock said attaching member with container, said attaching member includes a clip fastened to said attaching member, said clip is used to attach said container to a user pet, wherein the attaching member is made of a rigid material, wherein the plurality of fasteners are screws that secure the attaching member to a lateral side of the container wherein said clip is configured to attach said container to a user.

* * * * *